US005193619A

United States Patent [19]

Edwards et al.

[11] Patent Number: 5,193,619

[45] Date of Patent: Mar. 16, 1993

[54] WELL CONTROL APPARATUS

[75] Inventors: Jeffrey C. Edwards; Ray Johns, both of Aberdeen; Robert D. Buchanan, Belhelvie, all of Scotland

[73] Assignee: Exploration and Production Services (North Sea) Ltd., Reading, England

[21] Appl. No.: 768,856

[22] PCT Filed: Apr. 20, 1990

[86] PCT No.: PCT/GB90/00606

§ 371 Date: Oct. 8, 1991

§ 102(e) Date: Oct. 8, 1991

[87] PCT Pub. No.: WO90/13731

PCT Pub. Date: Nov. 15, 1990

[30] Foreign Application Priority Data

Apr. 28, 1989 [GB] United Kingdom ..... 8909892
Mar. 23, 1990 [GB] United Kingdom ..... 9006586

[51] Int. Cl.[5] ..... E21B 34/08; E21B 34/10
[52] U.S. Cl. ..... 166/321; 166/323
[58] Field of Search ..... 166/321, 323, 331, 334, 166/336

[56] References Cited

U.S. PATENT DOCUMENTS 3,814,182 6/1974 Giroux ..... 166/331 X
4,063,593 12/1977 Jessup ..... 166/321 X
4,125,165 11/1978 Helmus ..... 166/323
4,429,748 2/1984 Beck ..... 166/323 X
4,576,235 3/1986 Slaughter et al. ..... 166/374
4,646,838 3/1987 Manke ..... 166/321
4,657,083 4/1987 Ringgenberg ..... 166/374
4,691,779 9/1987 McMahan et al. ..... 166/321
5,048,611 9/1991 Cochran ..... 166/374

FOREIGN PATENT DOCUMENTS 2074634 11/1981 United Kingdom .
2080365 2/1982 United Kingdom .

*Primary Examiner*—Ramon S. Britts
*Assistant Examiner*—Frank S. Tsay
*Attorney, Agent, or Firm*—Brady, O'Boyle & Gates

[57] ABSTRACT

Apparatus for the venting and isolation of an oil well test tool drill string comprises reference pressure gas release apparatus having two spaced pistons (7, 11) located at opposite ends of the reference gas chamber (10) and blocking both a gas vent (17) to annulus and a hydraulic liquid passageway (22) extending further up the test string, the pistons being held together by a shear pin (13) until the application of a predetermined higher pressure across those pistons causes the pin to shear, allowing sequential movement of the two pistons toward each other, firstly opening the gas vent to annulus, and secondly opening the passageway (22) to a chamber (24) of hydraulic liquid. The hydraulic liquid pressure within this passageway then causes actuation of ball valve apparatus for isolating the upper section of tubing, which in turn enables transfer of hydraulic pressure to apparatus for venting the contents of the tubing to annulus.

20 Claims, 7 Drawing Sheets

WELL CONTROL APPARATUS

This invention relates to well control apparatus, and concerns in particular that apparatus employed in discontinuing a well testing procedure, especially an oil well testing procedure.

BACKGROUND OF THE INVENTION

Whether at sea or on land, the first stages in the production of a new hydrocarbon well—an oil well—are the drilling of the well bore itself through the various formations within the earth's crust beneath the drilling rig, followed by "casing" (the introduction and cementing into position of piping which will serve to support and line the bore) and the placing in the bore, at the depth of a formation of interest, of a device known as a packer, into which inner tubing (of smaller diameter than the casing) can subsequently be lodged.

The next work carried out is normally some programme of testing, for the purpose of evaluating the production potential of the chosen formation. The testing procedure usually involves the measurement of downhole temperatures and pressures, in both static and flow conditions (the latter being when fluid from the relevant formation is allowed to flow into and up the well), and the subsequent calculation of various well parameters. To collect the necessary data there is lowered into the well a test string—a length of tubing containing the tools required for testing. The flow of fluid from the formation of interest into the well bore and thus to the test tools is controlled by a valve known as a sub-surface control valve.

The operation of the various tools include in the downhole test string can be effected using one of three main types of mechanism. These types are those actuated by reciprocal motion of the pipe string (the inner tube, of which the test string constitutes a part), by rotational motion of the pipe string, or by changes in the pressure differential between the tubing and the annular space which surrounds it in the well— hereinafter referred to simply as "the annulus". Test strings wherein the tools thereof are actuated by changes in annulus pressure are at present much in vogue, and it is this type of actuation mechanism that is to be employed with the apparatus of the invention.

A mechanism of the annulus pressure-responsive type requires the provision and maintenance of a fixed "reference" pressure within the tool. This, used in conjunction with an adjustable (and higher) annulus pressure, allows the establishment of the chosen pressure differential necessary to control the operation of the appropriate component of the test string. The achievement of such a fixed reference pressure is the subject of our co-pending British Patent Application No. 89/07,098.1 (Publication No: 2,229,748A; FN P1049).

Following completion of the well testing procedure, it is necessary safely to "shut down" the test tools, and then to remove the test string from the packer assembly and pull it to the surface. These operations do, however, require careful control and planning. In the case of pressure-differential-actuated test tools, for example, the string will, at the end of testing, still contain the high pressure reference gas which has been used in creating the required differentials. It is extremely desirable for this gas in some way to be vented before the string reaches the well head, so that there are no potentially dangerous pressures trapped within the tools when the test string is received at the surface.

Additionally, it is an advantage if there be incorporated within the test string some means of isolating the upper portion of the tubing thereof, and of subsequently providing a route for communication between this tubing and the annulus, so that tubing-contained well liquid above the test string can then be circulated out of the tubing before it is raised to the surface. The isolation is conveniently accomplished using a ball valve suitably placed near the top of the test string, and such a ball valve particularly suitable for effecting this isolation is described in our co-pending British Patent Application No. 89/09,903.0 (Publication No: 2,231,069A; FN P1062). However, reliance upon a single valve is not advisable, and consequently there is a strong case in favour of the utilisation of a second valve in the test apparatus. This latter valve can then be used either in addition to the main valve or, in the event of the latter not operating correctly, as an alternative thereto.

The present invention seeks to facilitate the procedure for discontinuation of an oil well testing programme by providing apparatus for the venting and isolation procedures just described. Moreover, the apparatus permits those operations to be carried out as an automatic sequence, following the application of a single actuating pressure pulse to the annulus. For the venting of the reference gas, the invention suggests pressure release apparatus having two spaced pistons located at opposite ends of a chamber filled with that gas and blocking both a gas vent to annulus and a hydraulic liquid passageway (to further up the test string), the pistons being held together by a shear pin until the application of a predetermined pressure (higher than the gas reference pressure) at the outside ends of those pistons causes the pin to shear, allowing sequential movement of the two pistons towards each other, with the effect of firstly opening the gas vent to annulus, and secondly opening the passageway to a chamber of hydraulic liquid.

The hydraulic liquid pressure within this passageway then causes actuation of ball valve apparatus for isolating the upper section of tubing. This apparatus is in the form of a ball-valve-driving piston blocking another passageway for hydraulic liquid, which piston is forced to move under the influence of the pressure, breaking a restraining shear pin as it does so, and closing the ball valve while opening this other hydraulic liquid passageway, permitting transfer of hydraulic pressure to apparatus for venting the contents of the tubing to annulus. Finally, this venting apparatus contains a longitudinally-movable sleeve member the position of which determines whether or not flow is permitted, via a vent port, from the test string tubing to the annulus.

SUMMARY OF THE INVENTION

In one aspect, therefore, this invention provides pressure release apparatus useable in a well test pipe string which comprises, positioned and/or mounted within the string tubing;

a gas chamber for holding reference pressure gas;

two spaced slidable pistons, positioned one at each end of the gas chamber, and each adapted to have tube-external pressure acting on the outer end thereof, which pistons are capable of relative movement along the gas chamber but which are (normally) secured together by one or more shear pin;

a vent port permitting escape of the reference gas out of the pipe string, but (normally) blocked by one or other piston; and a liquid chamber for holding hydraulic liquid, and connectable to a passageway, the connection being (normally) blocked by one or other piston;

whereby application of a sufficient pre-determined externally-derived pressure to both pistons causes pin-shearing relative movement of the pistons thus permitting subsequent piston movement to open both the reference gas vent port and the passageway to the hydraulic liquid chamber.

In a preferred aspect, the invention provides valve operating apparatus for operating a ball valve useable with the pressure release apparatus, which valve operating apparatus comprises, positioned and/or mounted within the string tubing:

a slidable piston, operatively connected to the valve ball, but which is (normally) held stationary by one or more shear pin; and a passageway for holding a hydraulic liquid and (normally) blocked by the piston;

wherein application of a sufficient predetermined pressure differential across the piston causes pin-shearing movement thereof, both actuating the valve and opening the passageway.

And in a preferred aspect of this ball valve operating apparatus, the invention provides venting apparatus which comprises, positioned and/or mounted within the string tubing:

a slidable piston, (normally) held stationary by one or more shear pin; and a vent port for permitting escape of the pipe string's contents out of the pipe string, but (normally) blocked by the piston;

wherein application of a sufficient predetermined pressure differential across the piston causes pin-shearing movement of the piston, thus permitting subsequent piston movement to open the vent port.

BRIEF DESCRIPTION OF THE DRAWINGS

An example of the invention will now be described, though by way of illustration only, with reference to the accompanying drawings, in which:

FIGS. 2D' and 2E' are longitudinal views, half in cross-section, showing the position of the elements of the apparatus shown in FIGS. 2D and 2E after completion of the testing procedure and the upper portion of the tool isolated, and its contents circulated out.

DESCRIPTION OF THE PREFERRED EMBODIMENT

Figure 1:
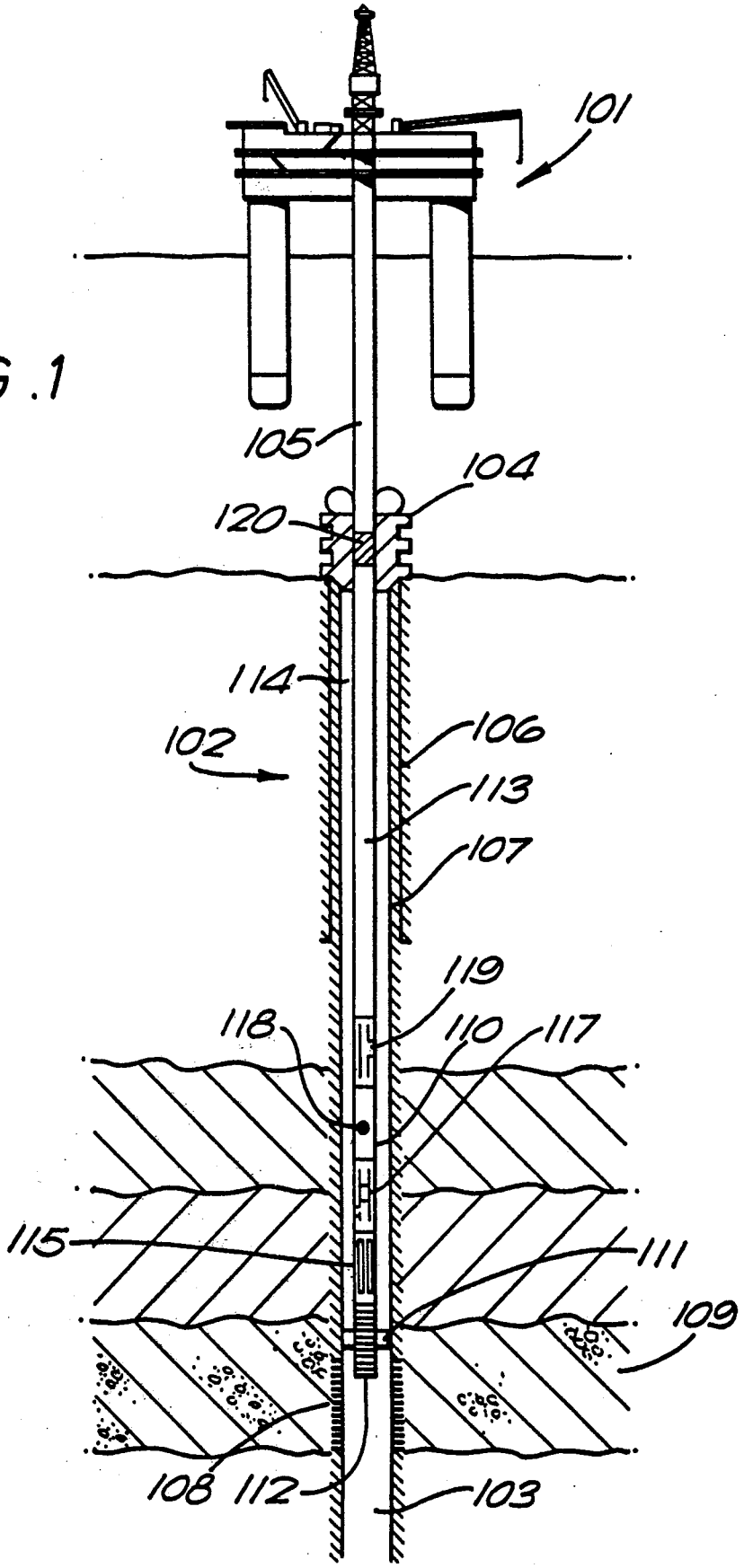
FIG. 1 is a schematic view of an offshore drilling rig and a simplified vertical sectional view of an offshore oil well with a test string including apparatus of the invention.

The invention in its various aspects is for the most part intended for use in connection with the testing of wells, specifically oil wells, and is therefore described in connection therewith hereinafter. Indeed, the operation of the invention is described as though the pipe string were located within the bore of the well, the space therearound being the annulus to which tube-external pressure ("annulus pressure") is applied to operate the various parts of the apparatus.

The pressure release apparatus of the invention's first aspect includes a gas chamber 10 which in use contains reference pressure gas. Most conveniently, this chamber is generally annular and lies within the tubing walls of the test string. The gas (which may be any of those commonly employed to provide reference pressure—nitrogen, for example) may be supplied to the chamber in any suitable way; for instance, via a narrow tubing—wall—contained passageway 3 connected to the test string's main reference pressure gas reservoir (as described and claimed in our aforementioned Application No: 89/07,098.1.

The reference gas chamber 10 has a piston at each end—upper 11 and lower 7, when in use—thereof. Preferably both are elongate floating annular pistons, of dimensions (naturally) which are suited to the size of the gas chamber. In a particularly preferred embodiment of the invention, each piston has a greater external diameter at the point thereof which in use lies adjacent the extreme end of the gas chamber 10, and is at that point sealed (conveniently by a suitable elastomer seal) to the gas chamber walls, thus ensuring complete closure of the gas chamber. The remainder of each piston lies at least partly within the gas chamber itself, and advantageously one of them 7 is provided with a latch profile 9 into which a latch key 12 located on the other 11 may lock when the apparatus is operated in order to hold the two pistons 7 and 11 together, and so prevent them moving to re-block the gas vent port 17 or the hydraulic liquid passageway 22. This latch key and profile may take any convenient form.

Each piston has tube external—annulus—pressure acting towards its outer end. This pressure may, in each case, be applied either directly or indirectly: in the preferred embodiment of the invention, however, it is applied to the lower piston directly, via a simple port 5 to annulus, and to the upper piston indirectly, via a chamber 24 containing a hydraulic liquid (this liquid, also referred to hereinafter, may be of any convenient kind, and serves to prevent the influx of well liquid—principally drilling mud—into inner parts of the test string, where it could cause blockages).

The piston 7 and 11 are capable of relative sliding movement along the gas chamber 10, 14—that is to say, they are engineered such that they may travel longitudinally so as to lie one ensleeved within the other—but in their initial positions, one at each end of the reference gas chamber, their movement in this manner is prevented by one or more shear pin 13 which holds them in place. This pin 13 ensures that the pressure release apparatus is not unintentionally actuated following those pulses of increased annulus pressure applied during the well testing procedure to operate the testing tools. Accordingly, its pressure rating (or, in the case of more than one pin, the total rating) must be greater than the highest pressure differential required for actuation of any of those tools. The apparatus has been operated successfully using an applied annulus pressure differential of 2,500 PSI and five shear pins each with a rating equivalent to an annulus overpressure of 500 PSI.

The vent port 17 to annulus through which the reference pressure gas is released is a simple port through the outer tubing walls, the exit of which is blocked by the body of either of the gas-chamber-contained pistons. In the preferred embodiment of the invention, this is that piston 11 which in use lies at the upper end (in use) of the chamber.

It is in general preferred if one piston (conveniently the lower piston 7) move first, followed by the other piston (the upper one 11). This may be achieved by so shaping each piston that the effective area acted on by the increased tubing external pressure is greater in the case of the gas-vent-blocking (lower) piston.

Although one piston could (normally) block the vent port while the other (normally) blocks the hydraulic liquid passageway 22, it is convenient—as shown in the Drawings described in detail hereinafter—to have one piston, and advantageously the upper one 11, (normally) block both port 17 and passageway 22.

There is also provided within the pressure release apparatus a chamber 24 which in use holds a hydraulic liquid, and has a passageway 22 associated therewith. This liquid chamer 24 is, like the gas chamber 10, preferably annular in form. Its volume is determined by the volume of hydraulic liquid required to actuate the other tools contained within the test string. In the preferred embodiment of the invention, as will be described further hereinafter with reference to the accompanying Drawings, it is this chamber 24 of hydraulic liquid which also provides the indirect annulus pressure to the upper gas-chamber-contained piston 11 as previously described. The annulus pressure is communicated to the liquid via a floating piston 25 adjacent a port 26 to annulus at the passageway 22 distant end of the liquid chamber 24.

Extending from the hydraulic liquid chamber 24 is a passageway 22 the entrance to which is initially blocked by the body of (preferably) the upper 11 of the two gas chamber pistons 7, 11. This passageway 22 is advantageously of relatively narrow bore, and thus may be located within the outer tubing 8 walls. In the preferred embodiment of the invention it leads to the valve-operating apparatus of the second aspect of the invention, which is described in more detail hereinafter. When the well testing procedure has been completed, application of the predetermined pressure to the annulus actuates the pressure release apparatus, causing the lower piston 7 to move upwards, shearing the pin 13 as it does so, thus enabling the upper piston 11 to move downwards and thereby opening both the reference gas vent port 17 and the passageway 22 (so allowing hydraulic liquid from the chamber 24 to flow into the passageway 22). The hydraulic liquid at this (relatively high) pressure is thus transmitted to the ball valve 37, permitting the closure thereof which constitutes the second stage of the shut down procedure.

The ball valve-operating apparatus of the invention's preferred aspect utilises a slidable piston 39. This is conveniently another elongate annular piston 39, about 25–30 cm (8–12 in) in length. It is "slidable" in a longitudinal direction, and for a limited distance, preferably within an annular chamber 47 set in the tubing walls and held initially at atmospheric pressure. The volume of this chamber is such that the pressure therein does not exceed about 100 PSI when compression occurs due to the movement of the piston. Most preferably there is on the body of the piston 39 a latch key 45 which, at the end of the piston's travel, may co-act with a corresponding latch profile 46 on the inner tubing wall 42 and thus prevent any piston 39 return movement.

The piston 39 is operatively connected to the valve ball 37. Both the piston itself and the mechanism by which it is operated by the piston may be broadly conventional. Thus, the ball 37 is conveniently a sphere of approximately 10 cm (4 in) diameter with a passageway therethrough about 5 cm (2 in) in diameter, and having flattened opposing sides constituting bearing surfaces which locate the ball 37 within the width of the passageway 4. The ball is housed within a seating 35, 38 adjacent the internal walls 28 of the tubing within which it operates. The purpose of the seating of this, as any other, ball valve, is to ensure a sealing yet slidable fit with the ball. Conveniently it takes the form of two generally annular pieces set into the internal walls of the tubing. In the preferred embodiment of the invention the piston 39 is directly connected to the ball 37 via a pin 36 projecting therefrom which co-acts with an off-axis slot in the ball's flattened side so that longitudinal movement of the piston 39 causes the ball 37 to rotate.

The piston 39 is, prior to actuation, held stationary by one or more shear pin 4 set between the piston and part of the inner tubing 42 walls. This pin 44 merely ensures that the piston is kept in place whilst the apparatus is being assembled and the test string run in to the well, and therefore need only be of a very modest rating—say, equivalent to an annulus overpressure of 600 PSI.

Operation of the ball valve is initiated by the application of a predetermined pressure differential across the piston 39, thus providing at the . . lower . . end thereof a pressure greater than the annular chamber 47 -contained atmospheric pressure acting on the other end. This pressure must additionally be of sufficient magnitude to cause the pin 44 to shear. It is conveniently supplied using a hydraulic liquid, and it is particularly advantageous if this hydraulic liquid pressure originate from the passageway 22 previously opened by the operation of the pressure release apparatus of the invention discussed hereinbefore. In the same way, the passageway 40 for hydraulic liquid opened by the ball—valve—actuating travel of the piston 39—which passageway 40 is again narrow, and best located within the tubing 8 walls—propitiously leads towards the venting apparatus of the invention's third aspect which is about to be described.

The venting apparatus of the invention's preferred aspect includes a slidable piston 54 by means of which liquid within the test string may be circulated out before the string is brought to the surface. In the preferred embodiment this piston 54 is an elongate sleeve, the body of which constitutes part of the internal wall of the test string tubing (the internal diameter of the sleeve is consequently in this case comparable to the tubing diameter 4).

Figure 2A:
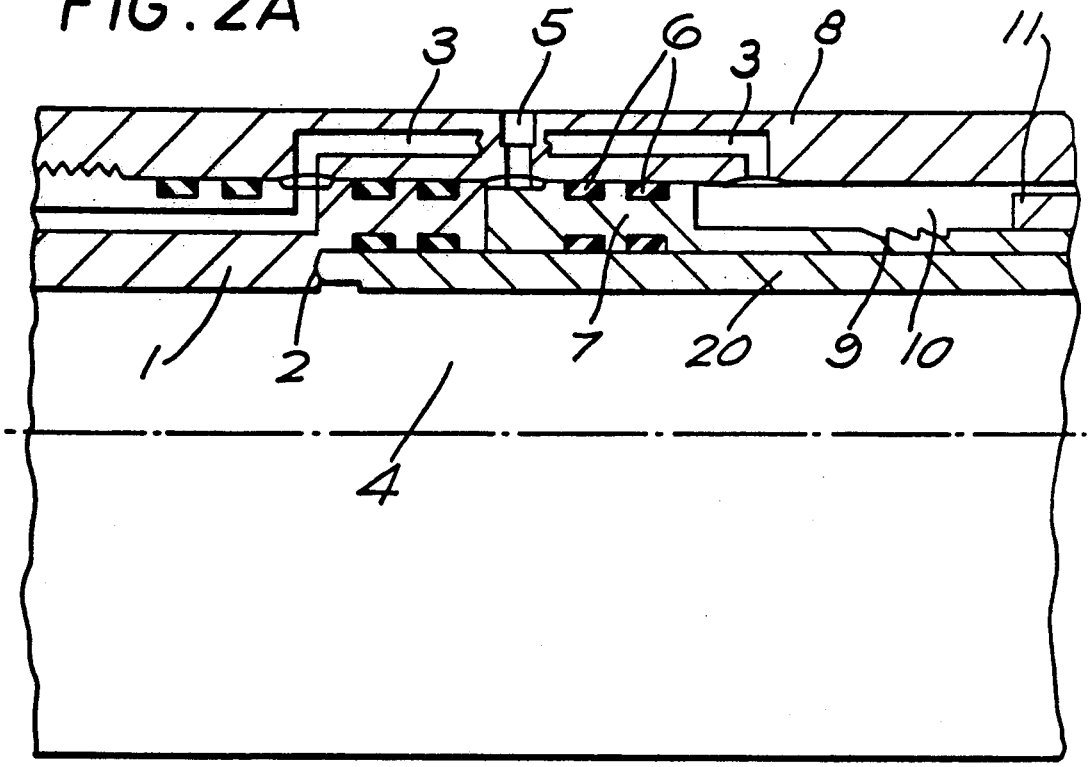
FIGS. 2A, 2B, 2C, 2D, 2E, 2F, 2G and 2H are enlarged longitudinal views, half in cross-section, of a test string incorporating an apparatus of the invention, with FIGS. 2A to 2H showing adjacent sections of the apparatus, the right-hand side of each individual Figure joining onto the left-hand side of the subsequent one, the left sides being the low sides in the test string, while the right sides are the high sides in the test string.
Figure 2B:
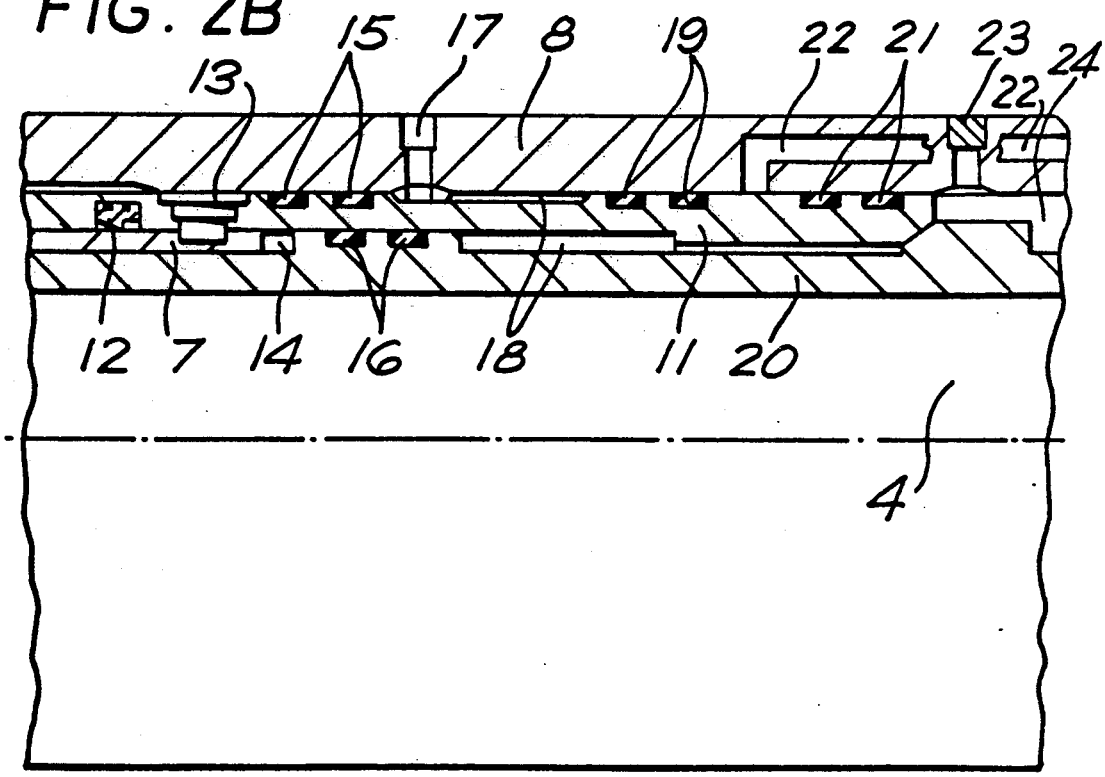
Figure 2C:
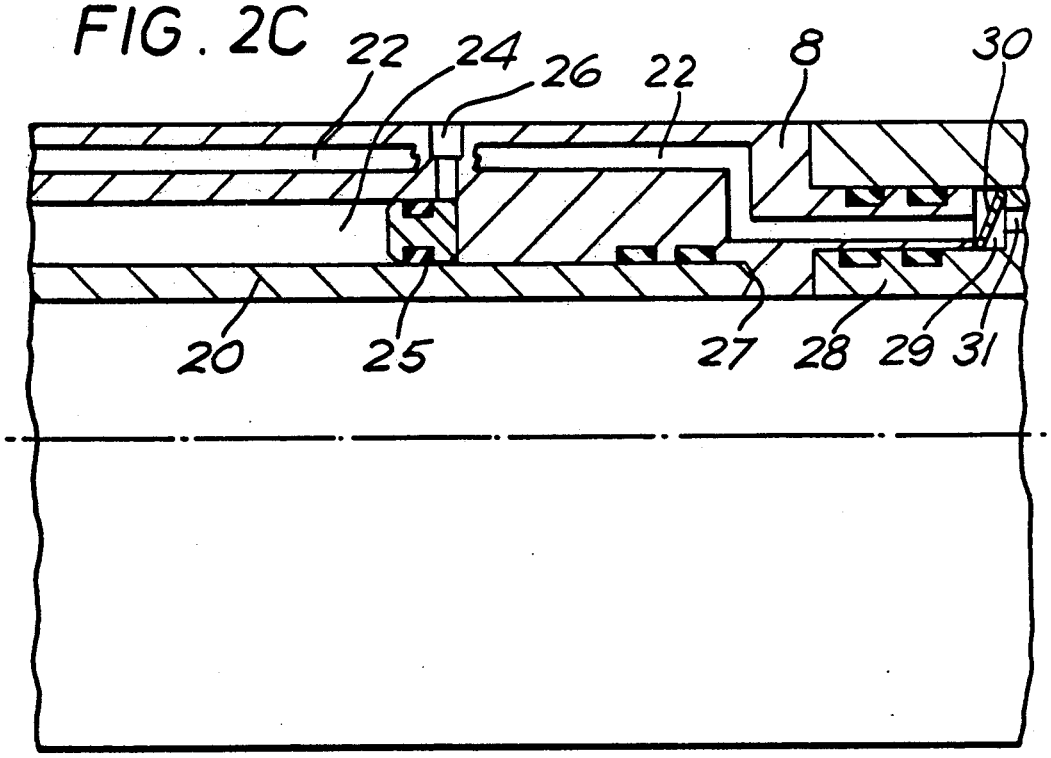
Figure 2D:
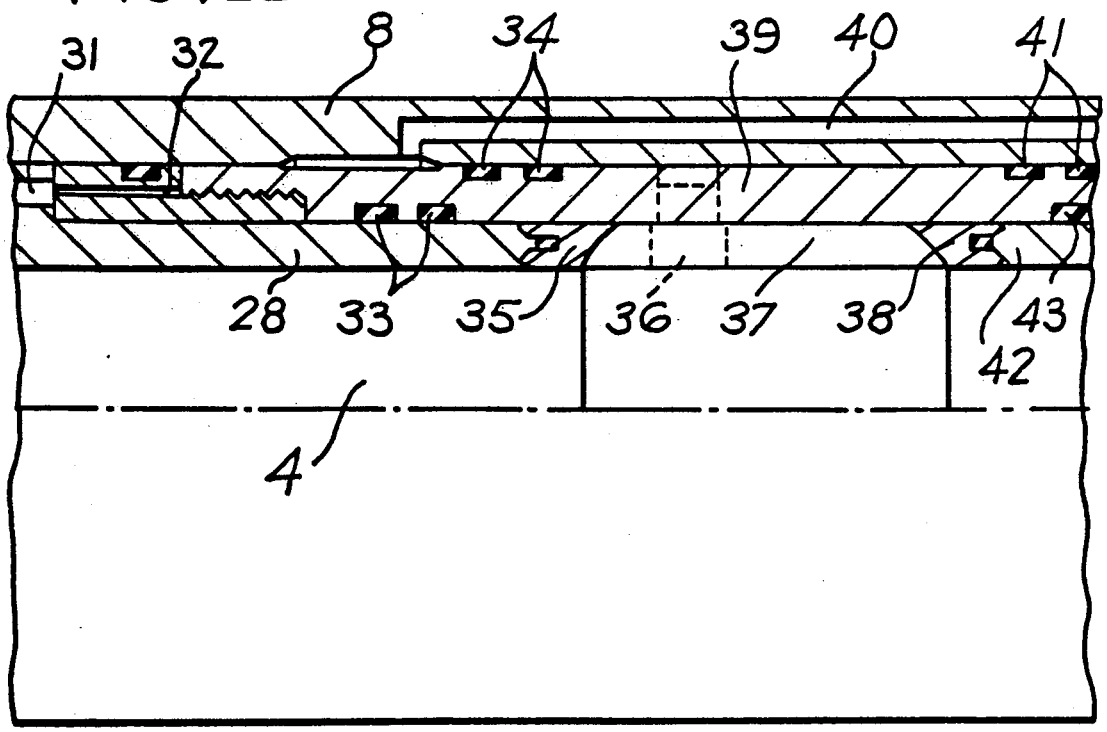
Figure 2E:
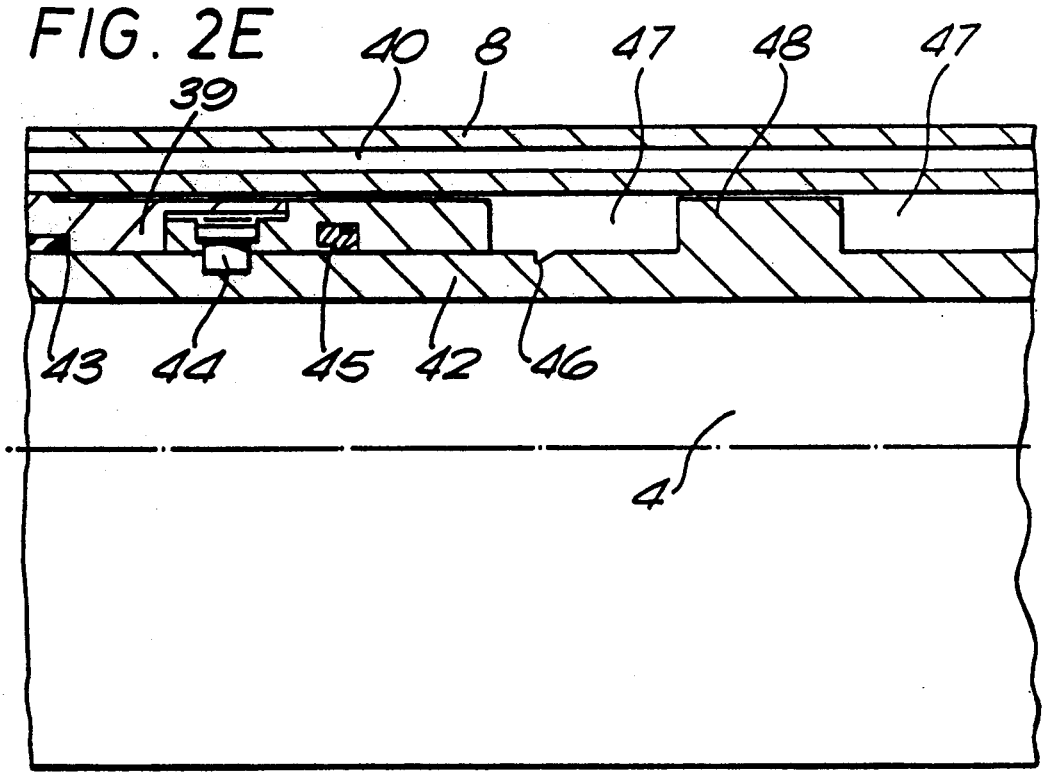
Figure 2F:
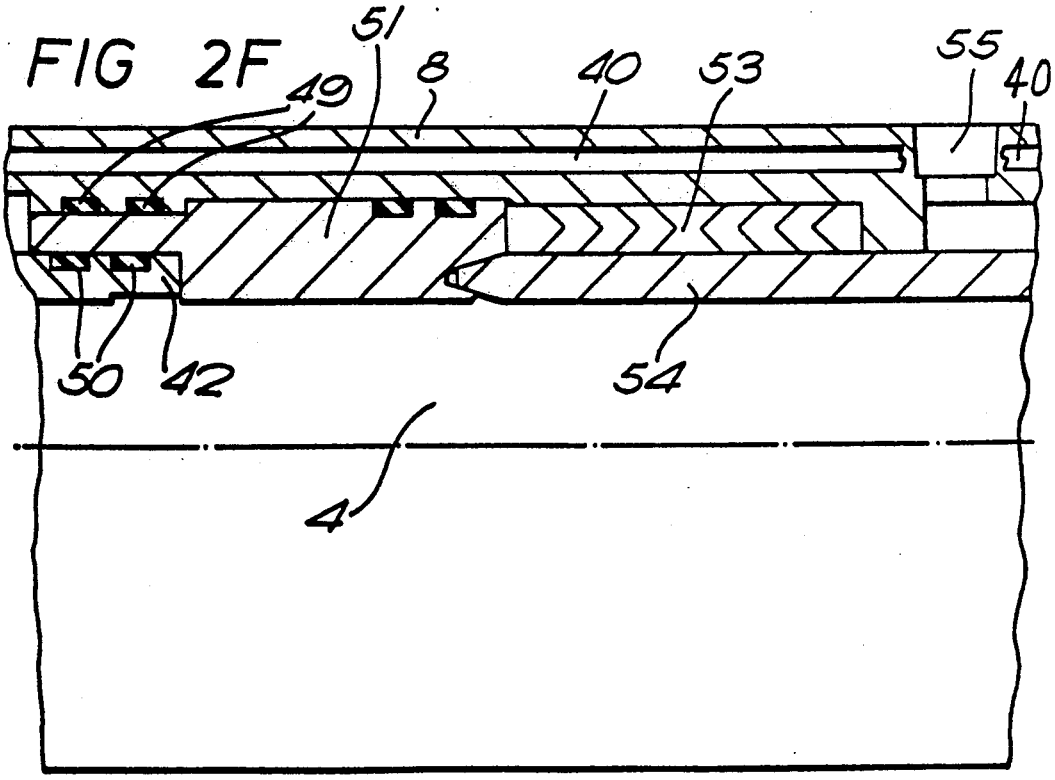
Figure 2D:
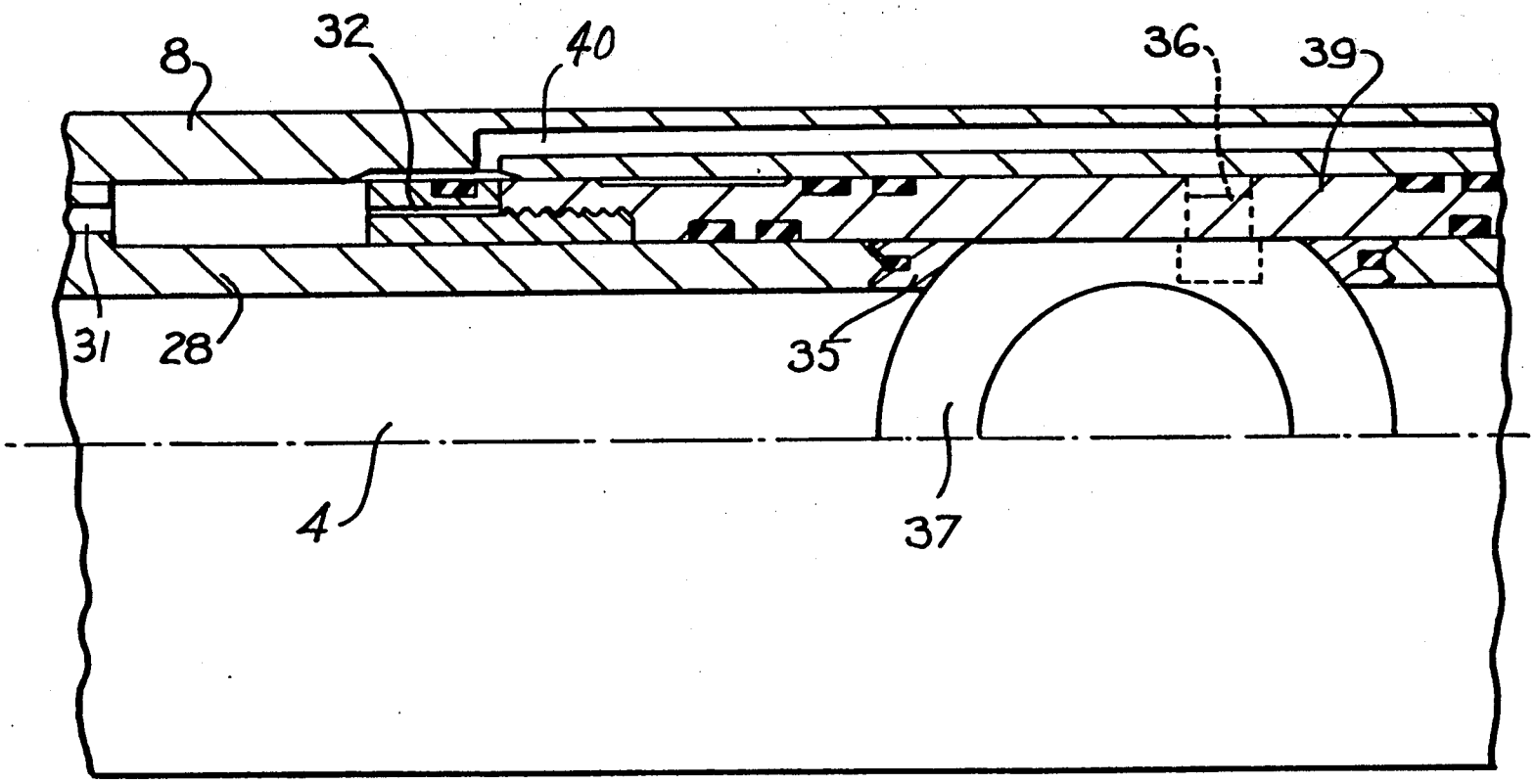
Figure 2E:
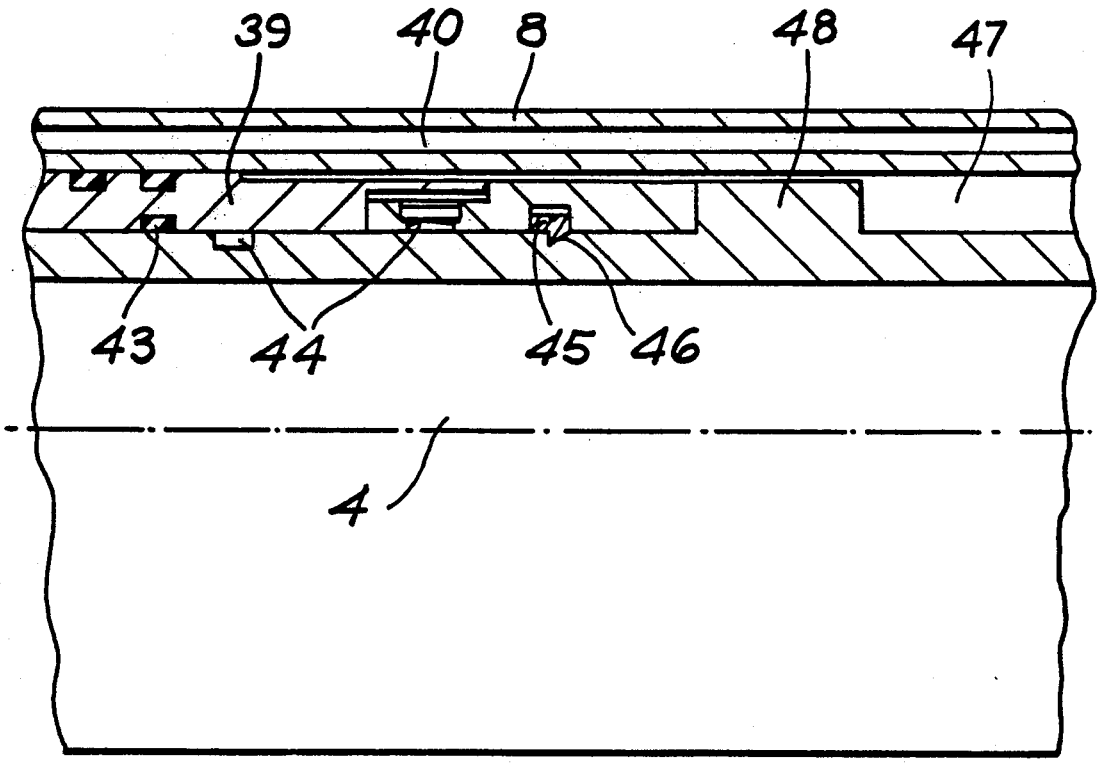
Figure 2G:
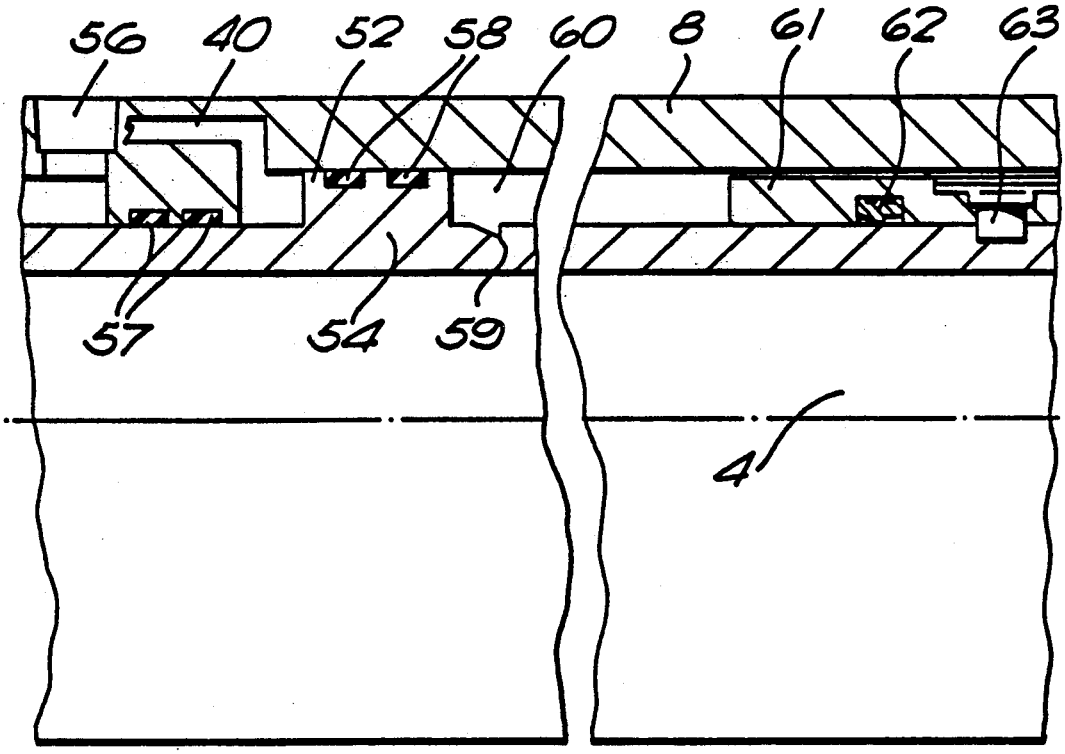
Figure 2H:
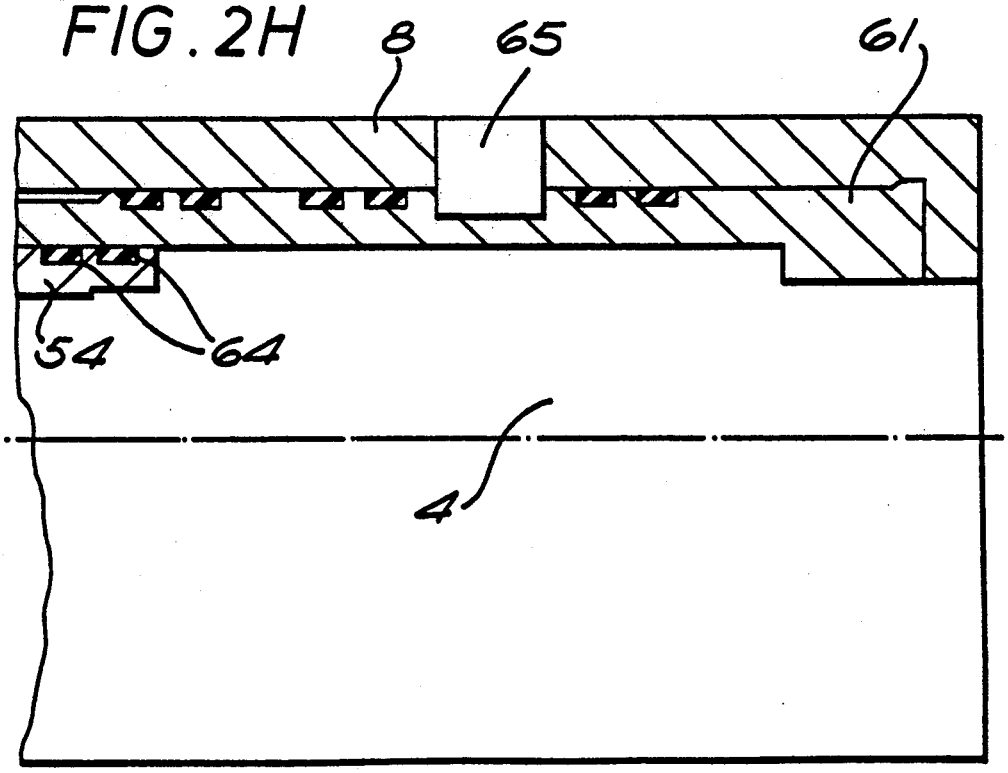

The piston 54 is longitudinally slidable within the test string, in an upwards (in use) direction, from an original position, FIG. 2F, where it is preferably sealed into place against another specially adapted part of the tubing walls known as the upper mandrel sub 51. The maximum distance through which the piston may slide once free of restraint is advantageously defined by an annular sleeve mandrel 61. In use this mandrel lies above the piston, partially ensleeving the upper end thereof. At its upper end is an inwardly-projecting shoulder against which the piston body will eventually come to rest.

Between the lower end of the sleeve mandrel 61 and a shoulder located on the tubing-distant (outer) side of the sleeve piston 54, there is preferably defined an annular chamber 60 at atmospheric pressure. This facilitates rapid movement of the piston 54 following application of the actuating pressure differential (as will be described in greater detail hereinafter).

The piston body 54 closes at least one vent port 56—that is to say, it lies between the test string tubing 8 and a vent 56 leading therefrom to the annulus through the tuning tubing wall. In the preferred embodiment of the invention there are as many vent ports as practical having regard to the tubing retaining the necessary physical strength, in order to achieve as high a flow rate between tubing and annulus as possible concomitant with structural stability. Four pairs of vent port 56, equi-angularly spaced, are satisfactory.

The sleeve piston 54 is initially fixed to the sleeve mandrel 61 by a shear pin 63 which prevents it from moving until intentionally actuated. A shear pin 63 with a rating equivalent to an annulus overpressure of 600 PSI has been found to be most satisfactory for this purpose.

The venting apparatus of the invention is driven by the creation of a pressure differential across the ends of the piston 54. This differential is preferably applied, as in the case of the apparatus described previously, via a hydraulic liquid, which transmits to the lower face of the piston shoulder 52 a pressure increase applied initially to the annulus from the well surface. In the preferred embodiment, this hydraulic liquid pressure is that which has been transported along the passageway 40 opened by the ball-valve-actuating piston 39 in the previously-discussed apparatus of the invention's second aspect. The upper face of the piston shoulder 52 experiences, as mentioned earlier, only atmospheric pressure within the annular chamber 60. Thus, the piston 54 is forced upwards, shearing the shear pin 63, and continues its travel until its upper face reaches the shoulder of the mandrel 61. During this movement direct communication is opened between the tubing 4 and the vent port 56.

Following its upwards travel, the sleeve piston 54, as with the other pistons, is prevented from returning by the action of a sleeve latch key 62 on the sleeve mandrel 61 and a corresponding latch profile 59 on the piston 54 itself.

As described above, the preferred embodiment of the invention incorporates all three pieces of inventive apparatus described herein—and, moreover, deploys them in a manner which permits their sequential and interdependent actuation. However, other embodiments of the invention are envisaged in which, for example, the ball valve apparatus need not be included but the tubing is instead closed off by the operation of the test string's usual sub-surface control valve (the provision of a second valve in the form of the . . safety circulating valve . . does, however, provide a valuable back up should the first valve fail). Another possible embodiment utilises two different circulating sleeve sections at different positions in the test string, and each of which—by changing the number of shear pins in the . . control section . . —will be operated by the application of a different annulus pressure.

The materials of manufacture of the apparatus of the invention may be any of those commonly used within the art for similar construction. Thus, the apparatus and tools within the test string may be of mild steel, and the seals of any suitable elastomeric substance.

Referring to the drawings in greater detail,

FIG. 1 depicts a floating drilling rig (101, not shown in detail) from which has been drilled an oil well (generally 102) having a well bore (103) reaching down to a rock stratum constituting the formation (109) of interest. Located at the top of the well bore 103 is a blow-out preventer mechanism (BOP; 104, not shown in detail) which is connected to the rig 101 by a marine riser (105). Cemented into the well bore 103 are a shallow casing (106) and a deep casing (107); the lower end of the latter has a multitude of perforations (as 108) permitting communication between the well bore 103 and the oil formation 109.

Situated within the well bore 103 is a test string (110) comprising tubing (113) ending in a set of test tools (see below). The string 110 is set at its lower end into a packer (111), and a seal sleeve (112) seals the packer 111 to the test string 110, thus isolating the tubing 113 thereof from the annulus (114).

Above the seal sleeve 112 is a gauge carrier (115) which contains electronic or mechanical gauges (not shown) which collect downhole pressure and temperature data during the test sequence. Above the gauge carrier 115 are a constant pressure reference tool (117) and the sub-surface control valve (118). A circulating sleeve (119) permits removal of any formation fluid remaining within the test string 110 prior to its withdrawal from the well bore 103. At the top of the test string is a subsea test tree (120) which serves both as a primary safety valve and as a support for the rest of the test string 110.

As is shown in FIG. 2, the components of the tool are located within a housing (8) within the walls of the test string tubing. At the lower end (FIGS. 2A, B and C) of the tool, situated between the internal tubing wall and a fixed inner mandrel (20), are two elongate pistons: a lower piston (7) and an upper piston (11). Prior to activation of the tool these pistons are held in position relative to each other by shear pins (13) in the piston bodies. The free lower end of the lower piston 7 initially lies adjacent a lower end sub (1); the upper end of the upper piston is similarly restrained by the body of the inner mandrel 20.

On the body of the lower piston 7 is a latch profile (9), which corresponds to a latch key (12) located on the upper piston 11. Well liquid from the annulus enters the tool by way of a port (5) adjacent the lower face of piston 7. Elastomer seals (6) prevent communication between the gas filled chambers (10 and 14) and the well liquid entering port 5.

Well liquid also enters the tool through another port (17) which opens to annular chamber (18) surrounding the centre section of upper piston 11.

Above the upper piston 11 is another annular chamber (24) which contains hydraulic oil, initially at atmospheric pressure. This chamber, which may be charged prior to use of the tool via a subsequently sealed port (23), is bounded at its lower end by upper piston 11 and at its upper end by a floating piston (25). A further port to annulus (26) is located adjacent the upper face of the piston 25.

Further up the test string tubing (FIGS. 2D and E) lies the tool's ball valve. The ball (37) is housed within lower and upper ball seats (35 and 38 respectively), which are in turn set between a lower bore mandrel (28) and an upper ball mandrel (42). An elongate ball valve piston (39) is situated between the mandrels (28, 42) and the housing 8. The piston is connected to ball 37 via a ball pin (36), but its movement is initially restricted by a shear pin (44). A latch key (45) on the piston 39 corresponds to a mandrel latch profile (46) on upper ball mandrel 42. An annular chamber (47) adjacent the upper end of piston 39 contains gas at atmospheric pressure. Projecting into this chamber from the upper ball mandrel 42 is a mandrel stop (48). A passageway (22) transmits, once the tool has been actuated, pressurised hydraulic liquid to the lower face of ball piston 39.

The uppermost part (FIGS. 2F, G and H) of the tool is the venting apparatus or circulating sleeve section. An elongate sleeve piston (54) having a shoulder (52) thereon extends upwards from an upper mandrel sub (51). The piston 54 is fixed at its upper end to a sleeve mandrel (61) by a shear pin (63). The piston body in its initial position serves to prevent communication between the tubing bore (4) and two vent ports (55 and 56) to annulus. A sleeve latch profile (59) on sleeve piston 54 in use permits the piston to be retained in position by sleeve latch key (62) on sleeve mandrel 61.

Between the body of the sleeve piston 54 and the tubing walls is an annular chamber (60), held initially at atmospheric pressure. Seals (64) ensure that there is no communication between this chamber and the tubing bore 4.

A passageway 40 allows the flow of hydraulic liquid within the tool to the lower face of sleeve piston shoulder 52. Seals (57) prevent communication of the liquid from this passageway to ports 55 and 56, whilst further seals (58) prevent that liquid from entering annular chamber 60.

Prior to commencement of the testing programme, the test string containing the tool is lowered into the well bore. As this lowering progresses the reference pressure of the nitrogen within passageway 3 and chambers 10 and 14 increases so as always to equal the instantaneous hydrostatic pressure. Well liquid, also at hydrostatic pressure, enters the tool through ports 5, 17 and 26. Floating piston 25 consequently experiences a pressure differential, with well liquid at hydrostatic pressure acting on its upper face, and hydraulic liquid at atmospheric pressure acting on its lower. The piston 25 is thus induced to more downwards until the hydraulic liquid within the chamber 24 attains hydrostatic pressure.

When the required test depth is reached, the test string is stabbed into the packer (as shown in FIG. 1). The reference pressure within the test string's reference gas reservoir (not shown in FIG. 2) is then "trapped" at the hydrostatic pressure. This may be carried out by the application to the annulus from the top of the well of a pressure a predetermined amount greater than the hydrostatic pressure acting on the tool at the test depth. This application creates a pressure differential across lower piston 7, with the new increased annulus pressure acting, via port 5, on its lower face and only hydrostatic—reference—pressure acting on its upper face from chamber 14. However, the piston does not move in these circumstances because this pressure differential is insufficient to cause shear pin 13 to break.

Once the trapping of the reference pressure has been effected, the application of the higher pressure to the annulus is discontinued, and the components of the test string which communicate with the annulus once more experience hydrostatic pressure only. During the well testing programme various increased pressures are similarly periodically applied to the annulus in order to actuate the test tools within the string. However, in all these cases the pressure differential created across lower piston 7 is still too small to cause shear pin 13 to break, and thus the tool of the invention is not actuated.

Upon completion of the testing procedure, there is applied to the annulus a larger pressure than any of those previously employed, which again produces a pressure differential across lower piston 7, but this time one which is sufficient to break shear pin 13. Thus the piston 7 moves upwards, until it is halted by a projecting stop on inner mandrel 20. At the same time, the pressure differential created across upper piston 11 (with the reference pressure of chambers 10 and 14 acting on its lower face and the increased annulus pressure acting on its upper face via port 17 and chamber 18) causes that piston, now no longer restrained by shear pin 13, to move downwards. This travel continues until the piston 11 reaches the upper face of piston 7, and latch key 12 locks into latch profile 9 (thus preventing return movement of upper piston 11). Once this travel is complete, passageway 22 is open to the hydraulic liquid (at the increased annulus pressure) within chamber 24. This pressure is thus now communicated upwards through the tool in passageway 22. A further consequency of the movement of upper piston 11 is that the positions of seals thereon (15 and 19) are now such that there is direct communication between reference-gas-containing annular chamber 10 and port 17 to annulus. This allows the gradual venting to annulus of the now redundant reference pressure as the test string is lifted out of the well, ensuring that no high gas pressures are trapped within the test string when it is removed from the well.

The applied increased annulus pressure is transmitted along passageway 22 to the lower face of ball valve piston 39. The upper face of this piston, however, only experiences the atmospheric pressure of annular chamber 47. The piston 39 is thus suddenly forced upwards, breaking shear pin 44, until its upper face reaches mandrel stop 48 as shown in FIG. 2D' and FIG. 2E'. This causes the valve ball 37 to be rotated by ball pin 36 into its closed position, preventing further flow of well fluid (oil) up the tubing bore 4. A sealing fit is ensured by metal-to-metal seals between the ball 37 and the ball seats 35 and 38. The ball valve piston 39 is locked into its new position by latch key 45 and latch profile 46. This position of the piston 39 allows direct communication between passageways 22 and 40, the latter of which now also fills with hydraulic liquid at the increased annulus pressure. If, exceptionally, incomplete movement of valve piston 39 prevents this communication, hydraulic oil will in any event eventually pass from passageway 22 to passageway 40 by way of a narrow bore passageway (32).

Passageway 40 permits hydraulic liquid at increased annulus pressure to reach the lower face of sleeve piston shoulder 52. A pressure differential is thus created thereacross, since the upper face is experiencing only the atmospheric pressure of chamber 60. This pressure differential causes upward movement of sleeve piston 54, shearing the pin 63, until the piston eventually reaches sleeve mandrel 61. This travel opens the tubing bore 4 to vent ports 55 and 56 (these are two of four like pairs disposed around the tubing). Latch key 62 co-acts with latch profile 59 to hold the sleeve piston 54 in position. The contents of the test string above the valve can then be circulated out of the test string prior to its release from the packer and elevation to the surface.

We claim:

1. A pressure release apparatus for use in a well test pipe string consisting of a multiplicity of sections of elongate tubular pipe, or tubing, joined end to end, each section comprising a tubular wall with an axial bore, the string containing therein a reservoir in which may be stored a main source of reference pressure gas, tube-external pressure surrounding the pipe string in use in a well, comprising mounted within the pipe string tubing:

an elongate reference gas chamber for holding reference pressure gas from the reservoir, the chamber having two ends one of which is in use the upper end and the other of which is in use the lower end;

two spaced slidable pistons, positioned one at each end of said reference gas chamber, each piston having an inner face, or end, facing toward the other piston, and an outer face, or end, facing away from the other piston, each said piston having an elongate body extending between its two ends, and each piston being adapted to have tube-external pressure acting on its outer end face, shear pin means, said pistons being capable of relative movement along said gas chamber but which are normally secured together by said shear pin means;

a vent port connected in communication with said reference gas chamber, and operative to permit escape of the reference pressure gas out of the pipe string, said vent port normally blocked by one piston, or the other piston; and a liquid chamber for holding hydraulic liquid, a passageway in said pipe string tubing, connection means between said liquid chamber and said passageway being normally blocked by one piston or the other piston;

whereby application of sufficient predetermined externally-derived pressure to both pistons causes pin shearing relative movement of said two pistons thus permitting subsequent piston movement to open both said vent port for the reference gas and said passageway to said liquid chamber for hydraulic liquid.

2. A pressure release apparatus as claimed in claim 1, including a narrow passageway within the tubular wall of said pipe string tubing connecting said reference gas chamber to said reservoir in said pipe string for said main source of reference pressure gas.

3. A pressure release apparatus as claimed in claim 1, wherein each piston of said two pistons positioned at each end of said reference gas chamber is an elongate floating annular piston.

4. A pressure release apparatus as claimed in claim 3, wherein each said piston has one external diameter throughout its lengths, and a greater external diameter portion at the point of said piston which in use lies adjacent the corresponding end of said reference gas chamber, and said greater external diameter portion of each said piston is sealed to the reference gas chamber walls, thus ensuring complete closure of the reference gas chamber.

5. A pressure release apparatus as claimed in claim 4, in which the elongate body of each piston lies at least partly within said reference gas chamber itself, a latch key connected on said one piston, a cooperating latch means on said other piston into which said latch key located on said one piston may lock when the apparatus is operated in order to hold said two pistons together, and so prevent them from moving to reblock said vent port for reference gas and said passageway to said liquid chamber.

6. A pressure release apparatus as claimed in claim 1, in which said liquid chamber is elongate and has opposite ends, means connected with said liquid chamber for subjecting it to tube-external pressure, and said liquid chamber connected axially adjacent said reference gas chamber, a simple port to annulus connected in communication with the said end of said reference gas chamber distant from said liquid chamber for hydraulic liquid, and the said end of said reference gas chamber which is adjacent said liquid chamber connected in communication with said liquid chamber for hydraulic liquid.

7. A pressure release apparatus as claimed in claim 1, said vent port through which reference pressure gas may be released comprising a simple port through the wall of the tubing, said vent port having an exit adapted to be blocked by the body of that reference-gas-chamber-contained piston which in use lies at the end of said reference gas chamber adjacent said liquid chamber for hydraulic liquid.

8. A pressure release apparatus as claimed in claim 1, in which said liquid chamber is elongate and has opposite ends, one of said ends of said liquid chamber positioned adjacent said upper end of said reference gas chamber, said passageway communicating between said one end of said liquid chamber and said upper end of said reference gas chamber, a port to annulus connection at the opposite end of said liquid chamber, a floating piston in said liquid chamber between said passageway and said port to annulus by which annulus pressure may be communicated to any hydraulic liquid within said liquid chamber.

9. A pressure release apparatus as claimed in claim 1, in which said passageway extending from said liquid chamber to said reference gas chamber is of relatively narrow bore, and is located within the wall of the tubing.

10. A pressure release apparatus as claimed in claim 1, including a ball valve, valve operating apparatus for operating said ball valve mounted within the string tubing comprising;

a slidable third piston having a body and two ends, said third piston operatively connected to said ball valve, second shear pin means connected between said string tubing and said third piston to normally hold said third piston stationary; and a second passageway in said string tubing for holding hydraulic liquid and being normally blocked by said third piston;

wherein application of a sufficient predetermined pressure differential across said third piston causes pin shearing sliding movement thereof, both actuating the ball valve and opening said second passageway.

11. A pressure release apparatus and valve operating apparatus as claimed in claim 10, in which said slidable third piston is an elongate annular piston slidable in a longitudinal direction, and for a limited distance, within an annular chamber set in the wall of the tubing.

12. A pressure release apparatus and valve operating apparatus as claimed in claim 10, including a latch means facing inwards of the tubing wall at a position adjacent the sliding travel of said slidable third piston, and latch key means on the body of said slidable third piston which, at the end of the sliding travel of said third piston coacts with said latch means, and prevents any return movement of said third piston.

13. A pressure release apparatus and valve operating apparatus as claimed in claim 10, wherein operation of said ball valve is initiated by the application of a predetermined pressure differential across said third piston, which pressure is supplied using a hydraulic liquid, and wherein this hydraulic liquid pressure originates from said passageway previously opened by the operation of the pressure release apparatus.

14. A pressure release apparatus and valve operating apparatus as claimed in claim 10, in which said second passageway for hydraulic liquid opened by the ball-valve-actuating travel of said third piston is narrow, and located within the wall of the tubing.

15. Apparatus as claimed in claim 10, including venting apparatus mounted within the string tubing comprising:

a slidable fourth piston, third shear pin means connected between said string tubing and said fourth piston to normally hold said fourth piston stationary; and second vent port means through the wall of the tubing for permitting escape of the fluid contents of the pipe string from the well out of the pipe string, said second vent port means normally blocked by said fourth piston;

wherein application of a sufficient predetermined pressure differential across said fourth piston causes pin shearing movement of the fourth piston, thus permitting subsequent fourth piston movement to open said second vent port means.

16. Apparatus as claimed in claim 15, in which said slidable fourth piston is an elongate sleeve having a body with inner and outer surfaces, and the inner surface defines part of the bore of the test string tubing.

17. Apparatus as claimed in claim 16, including an annular sleeve mandrel forming part of the string tubing, a projecting shoulder on said annular sleeve mandrel, upper mandrel means forming part of the string tubing and being spaced longitudinally from said annular sleeve mandrel, said slidable fourth piston is partially ensleeved by said annular sleeve mandrel, and is slidable from an original position in which said fourth piston is sealed into place against said upper mandrel means to a destination position in which it abuts said projecting shoulder on said annular sleeve mandrel.

18. Apparatus as claimed in claim 17, including a shoulder on the outer surface of said fourth piston sleeve, an annular chamber defined between said annular sleeve mandrel and said shoulder on the outer surface of said fourth piston and the tubing wall, and said annular chamber fillable with gas at atmospheric pressure, and operative to facilitate rapid movement of said fourth piston following application of the actuating pressure differential.

19. Apparatus as claimed in claim 15, in which said second passageway opened by said third piston is connected in communication with said slidable fourth piston, whereby hydraulic liquid transported along said second passageway creates the pressure differential across said fourth piston to slidably move said fourth piston to open said second vent port means.

20. Apparatus as claimed in claim 17, including a sleeve latch key means on said annular sleeve mandrel, and a cooperating latch means on said fourth piston sleeve, whereby following the travel of said fourth piston to said destination position said latch key means engages said latch means to prevent said fourth piston from returning toward said original position.

* * * * *